US005375262A

United States Patent [19]

Carter

[11] Patent Number: 5,375,262

[45] Date of Patent: Dec. 27, 1994

[54] LEG AND ARM PROTECTOR

[76] Inventor: James E. Carter, P.O. Box 291054, Port Orange, Fla. 32129

[21] Appl. No.: 997,028

[22] Filed: Dec. 28, 1992

Related U.S. Application Data

[63] Continuation-in-part of Ser. No. 730,060, Jul. 15, 1991, Pat. No. 5,173,967.

[51] Int. Cl.[5] ..... A41D 13/00

[52] U.S. Cl. ..... 2/23; 2/22; 2/46; 2/269

[58] Field of Search ..... 2/242, 16, 22, 23, 24, 2/46, 59, 62, DIG. 6, DIG. 7, 269, 270; 36/2 R; 602/4, 5, 12, 20, 21, 26, 41, 60, 62, 63, 78, 79

[56] References Cited

U.S. PATENT DOCUMENTS

| | | | |
|---|---|---|---|
| D. 299,562 | 1/1989 | Lee | 2/16 |
| 3,442,270 | 5/1969 | Steinman | 602/79 |
| 3,789,842 | 2/1974 | Froimson | 602/62 |
| 4,099,269 | 7/1978 | Porner | 2/16 |
| 4,120,052 | 10/1978 | Butler | 2/24 |
| 4,461,030 | 7/1984 | Knudsen | 2/22 |
| 4,642,815 | 2/1987 | Allen | 2/2 |
| 4,697,286 | 10/1987 | Cho | 2/22 |
| 4,706,302 | 11/1987 | Padfield et al. | 2/22 |
| 4,718,124 | 1/1988 | Sawicki et al. | 2/DIG. 6 |
| 4,942,624 | 7/1990 | Cho | 2/24 |
| 4,985,936 | 1/1991 | Jones | 2/269 |
| 5,031,247 | 7/1991 | Carter | 2/22 |
| 5,157,789 | 10/1992 | Klass | 2/46 |
| 5,173,967 | 12/1992 | Carter | 2/242 |

*Primary Examiner*—Clifford D. Crowder
*Assistant Examiner*—Gloria Hale

[57] ABSTRACT

The protective leg or arm covering is manufactured from a sheet of material that is cut or sewn into a blank having the shape to protect the portion of the leg or arm desired. The leg and arm protector features: (1) elastic webbing straps for versatility and hook and loop fasteners for closure; (2) a single strip of loop fastener placed down the middle of the inside of the leg and arm protector so that knee pads, shin guards, thigh pads, and/or arm guards can be secured by placing hook fasteners on one side of the pads and guards, also making them fully adjustable when placed along the inside strip of loop fastener; (3) a horizontal patch of hook fastener placed at the lower elevation on the inside of the leg and arm protector creating the ability for height adjustment to be made by securing to the strip of loop fastener placed along the middle of the inside of the leg and arm protector; (4) a pocket is formed by adding another sheet of material to the inside or outside surface of the leg and arm protector; this pocket can be used to insert pads, guards and other accessories for protection when placed on the inside of the leg and arm protector and as a carrying aid when placed on the outside of the leg and arm protector.

5 Claims, 12 Drawing Sheets

LEG AND ARM PROTECTOR

This is a continuation in part of Ser.No. 07/730,060 filed Jul. 15, 1991, now U.S. Pat. No.5,173,967, and relates to protective wearing apparel, and more particularly to comfortable exterior apparel for the protection of the leg and arm from the top of the arm to the bottom of the arm and from the top of the leg including the waist down to the top of the foot and the individual areas between said upper and lower elevations of the leg and arm.

BACKGROUND OF THE INVENTION

Description of the Prior Art

As man has developed through time, to the present day, he has needed a means in which to protect the leg and arm through these many developmental stages. One such device, as disclosed in U.S. Pat. No. 1,749,789 was needed only when man was able to turn solid metal into molten hot liquid. Prior to this ability to create molten liquid, man had no need for such a fireproof legging.

The same is true of the need that was the source for the development of the parent application and the present invention. No known prior art is known to exist that embodies the spirit of the present invention. The present leg protector was developed to protect the leg from the pain and injury sustained while operating gas powered string trimmers and brush cutters and the arm protector was developed to protect the arm from being burned by the muffler of said trimmers and the heat generated from their engines. Because of the recent invention of the string trimmer and brush cutter, this concept for leg and arm protection was only recently created. The present invention addresses this need directly; however, the leg and arm protection provided by the present invention can be applied in many different situations where protection is needed for the leg or arm.

The leg and arm protector offers the user a means of protection heretofore unknown or available and because of the serious pain, burn and/or injury that is caused by said trimmers a need exists for the protection of the leg and arm of the user that is comfortable, easy to put on, quick to take off, economical and with the adjustability to fit the leg or arm of different size wearers.

SUMMARY OF THE INVENTION

The present invention provides an inexpensive and lightweight leg and arm protector that secures using elastic webbing straps that stretch around the wearer's leg or arm and attaches to the front side of the protector using preferably patches of hook and loop fasteners placed on the end of the elastic webbing straps and across from the placement of the elastic webbing strap on the opposite lateral edge of said protector. The present invention is adjustable to the size of the user's leg and arm permitting normal blood circulation for the young and elderly. This is accomplished by the use of said elastic webbing straps and material; the material composition is determined by what the present invention is protecting the leg or arm from and the design and size of the material is determined by the area of the leg or arm that is in need of that protection. For example: if the user was trying to protect himself from dirt and wet grasses that using a string trimmer would generate, the leg protector from above the knee down to the top of the foot and made of moderate to heavyweight cotton goods would provide the user with sufficient protection and comfort in the are where the protection is needed. However, if the user was working with a brush cutter trimmer using a saw blade at the end of the trimmer to clear dense underbrush for fire prevention, the leg protector from above the knee down to the top of the foot would not be sufficient; the user would need protection from the waist down to the top of the foot with preferably a tough nylon exterior shell, not a cotton exterior shell, that would provide protection from the scratches and abrasions that the underbrush and flying debris could cause. Different leg and arm protection needs require different size protectors made from different types of materials. The size and the material composition is determined by the area and severity of the element that the user is trying to protect the leg and arm from.

The placement of a strip of preferably loop fastener on the inside of the leg and arm protector near the bottom elevation and running up the middle of the leg and arm protector allow for protective pads and guards that have a corresponding hook fastener placed on one side to be attached to said inside strip of loop fastener that not only secures said protective pads and guards in place but allows the protective pads and guards to be moved up or down and side to side for proper placement.

The strip of loop fastener placed on the inside of the leg and arm protector also functions as a means of allowing height adjustments to be made for the length of the leg and arm protector at the lower elevation. This is done by placing a patch of horizontal hook fastener at the base of the lower elevation on the inside of said protector so that when the lower elevation of the leg or arm protector is turned under and pulled up to shorten the length of said protector, the horizontal patch of hook fastener attaches to the inside strip of loop fastener creating a shorter leg or arm protector. The amount of height adjustment is determined by the length of the inside strip of loop fastener that the horizontal patch placed on the inside of the leg and arm protector at the lower elevation can attach to.

Other protective pads and guards can be worn with the leg and arm protector by securing a sheet of material to the already existing leg or arm protector. This additional sheet of material is attached to form a pocket that when applied to the inside of the leg and arm protector enables various shapes and size pads and guards made of various types of material depending on the type of protection needed to be inserted in exactly the area that the wearer needs the protection the most. When material is added to the outside of the leg and arm protector to form a pocket, it enables the wearer to put or carry objects that otherwise the wearer would have no place to store.

DETAILED DESCRIPTION OF THE INVENTION

Figure 1:
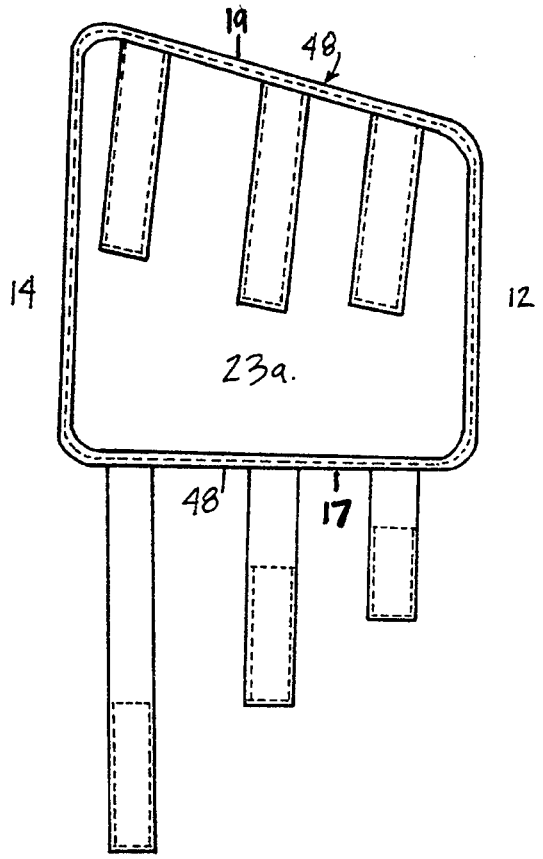
FIG. 1 shows the arm protector laid flat with the upper elevation on the left side and opened out to more clearly illustrate the details of the outside of the arm protector.

As shown in the drawings, the protective articles of clothing of the present invention are a leg and arm protector adapted to be worn around the leg or arm of the user. The leg protector 49*a.* and arm protector 33*a.* can extend the full length of the arm or leg including the waist 64 or the leg protector 56*a.*, 51*a.*, 25 and arm protector 23*a.* can cover a particular portion of said leg and arm depending on the area that is being protected.

The leg and arm protector is connected at the lateral edges 48 with elastic webbing straps that stretch around the leg or arm of the user and are secured by means, preferably of hook and loop fasteners that are sewn at the end of said elastic webbing straps and to the opposite lateral edge from the placement of said elastic webbing straps.

The use of elastic webbing straps eliminates the need for extra material that is required in the parent application so that closure can be made along the lateral edges 48. By eliminating the material that the elastic webbing straps have replaced you can be more specific in protecting the area of the leg or arm that is in need of protection without surrounding the entire limb with protective material. This allows for a lighter and more economical leg and arm protector without sacrificing any of the embodiments of the parent application.

The construction of the leg and arm protector allows the wearer to put on and take off the present invention without the necessity of removing any article from the leg, arm, foot or waist.

Figure 2:
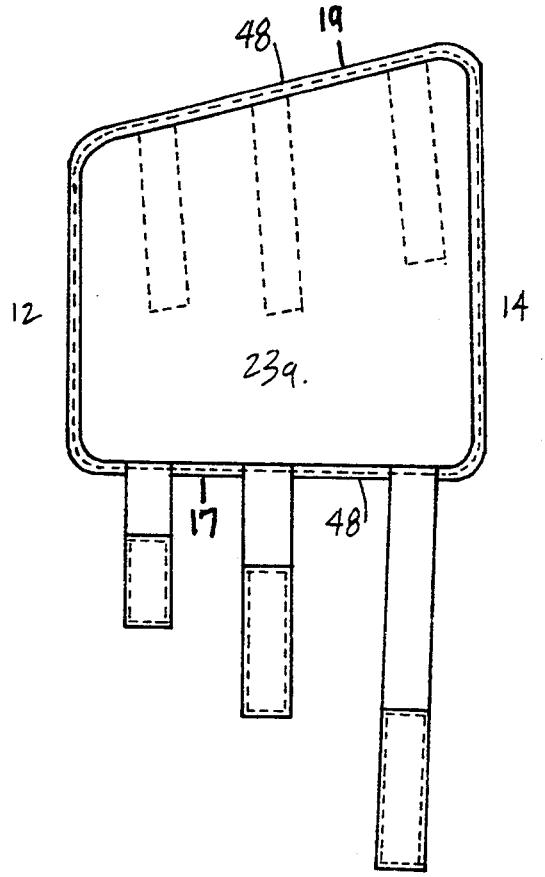
FIG. 2 is the back or inside view of the arm protector that will be in contact with the arm of the wearer, with the upper elevation on the right side. It is the opposite of FIG. 1.
Figure 3:
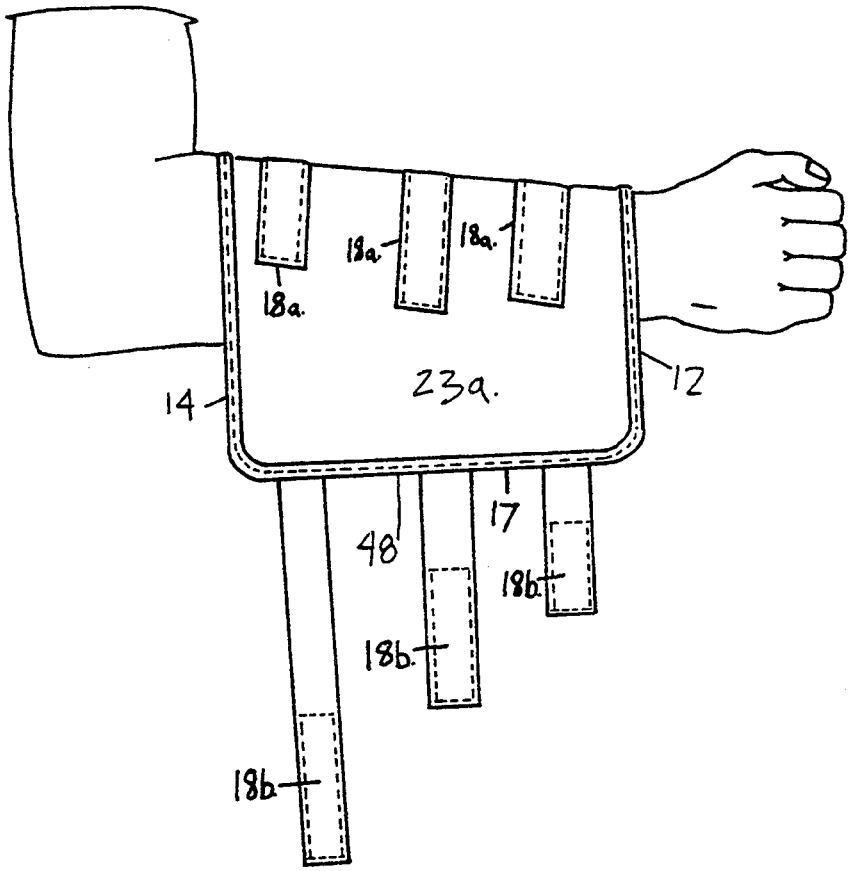
FIG. 3 is a perspective view of right arm with the arm protector partially applied thereto.
Figure 4:
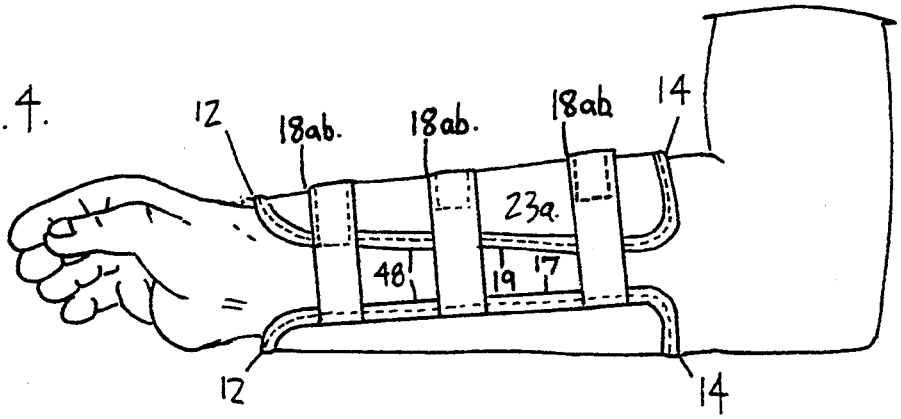
FIG. 4 is an inside view of the arm protector completely applied to a right arm.
Figure 5:
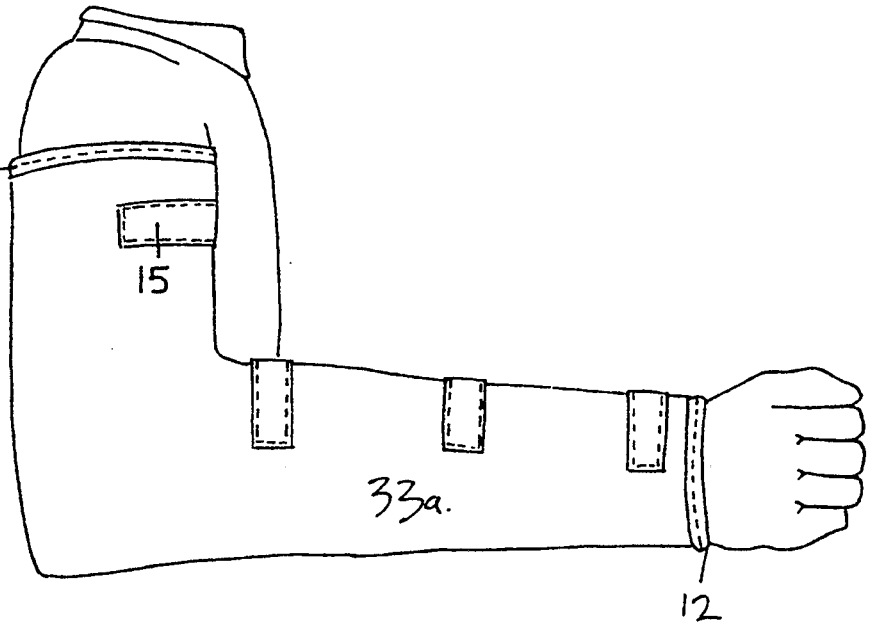
FIG. 5 shows an outside view of a full arm protector completely applied to a right arm.
Figure 6:
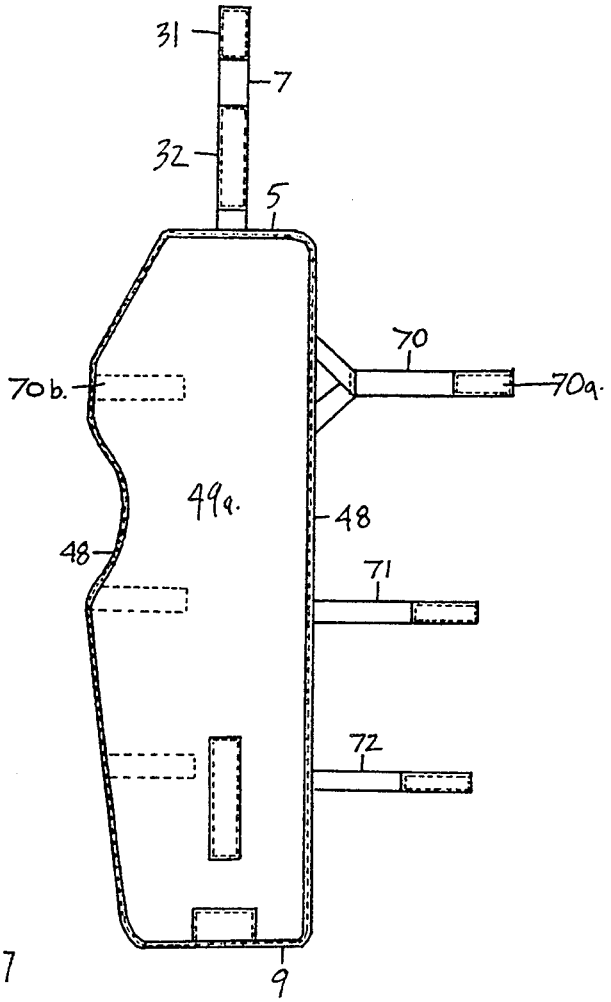
FIG. 6 shows the full leg protector laid flat and opened out to more clearly illustrate the details of the inside of the leg protector that will be in contact with the leg of the wearer.
Figure 7:
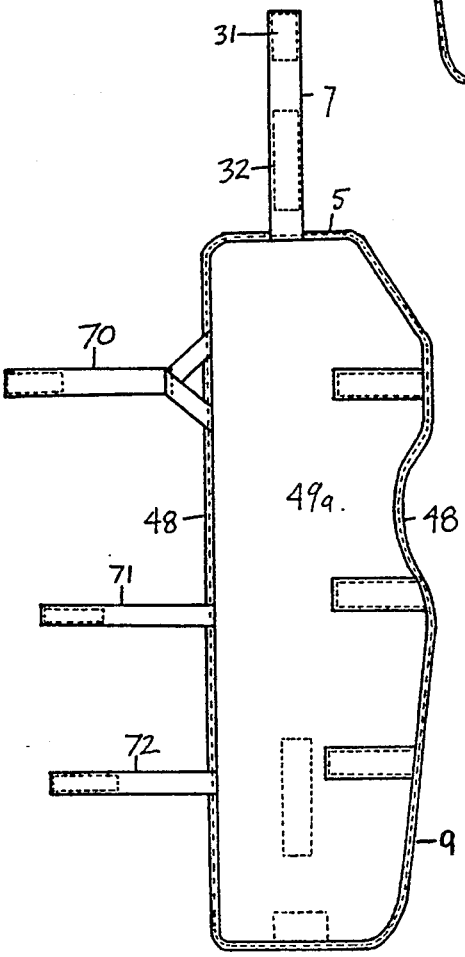
FIG. 7 is a front or outside view of the full leg protector. It is the opposite side of that shown in FIG. 6.

To put the arm protector 23*a.* on, lay the arm protector down flat FIG. 2 and place the forearm, wrist up, in the middle of the arm protector with the wrist in line with the lower elevation 12 and the elbow on the upper elevation 14, pull the outside portion 19 of the arm protector over and hold it on the forearm, pull the inside portion 17 of the arm protector over so that the preferably loop portions of the fasteners placed at the end of the elastic webbing straps 18*b.* secure 18*ab.* to the preferably hook portion of the fastener 18*a.* that is sewn on the outside of the arm protector, not allowing the arm protector to slip around or slide on the forearm. The full arm protector 33*a.* is put on the same as the aforementioned arm protector 23*a.* except that an additional elastic webbing strap and fastener 15 has to be secured at or near the upper elevation 14 as shown in FIG. 5. Secured properly the fit will feel comfortable without the possibility of creating any problems for normal blood circulation or similar discomfort.

Figure 8:
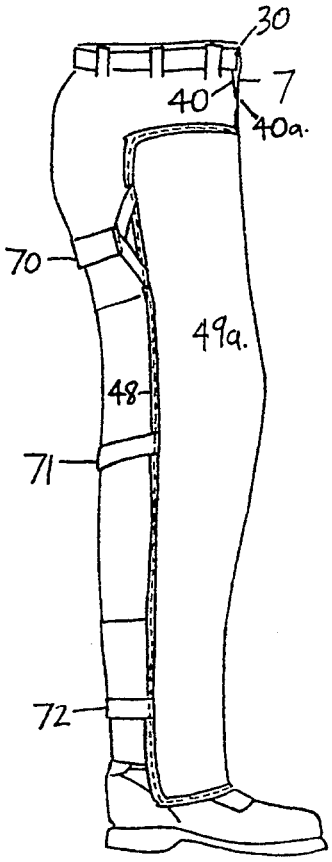
FIG. 8 is a view of the outside of a right leg with the full leg protector completely applied.
Figure 9:
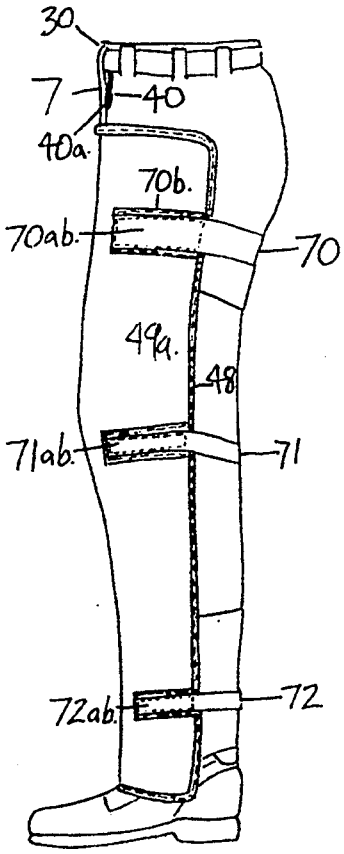
FIG. 9 is a view of the inside of a right leg with the full leg protector completely applied.

The full strap leg protector 49*a.* requires a strap 7 to be attached at the upper elevation 5 to accomodate the weight of the full leg protector and the fact that the thigh muscles when walking flex and then relax, causing a different circumference to be created with each step not allowing the strength of the elastic webbing straps 70, 71, 72 to be sufficiently strong enough to hold the protector in place. The strap 7, preferably made of an elastic webbing material, is secured by preferably hook and loop fasteners sewn on the inside of the strap. The loop preferably being at the top of the strap 31 and 3 inches in length and the hook 32 located preferably 2 inches below the loop fastener and extending 5 inches in length and both preferably being 2 inches in width, is placed over the top of a belt 30 FIG. 8, 9 or through a belt loop and pulled down and preferably secured on the inside 40 so that the end of the strap 40*a.* will not be exposed and accidentally caught on something causing separation of the hook and loop closure. The full strap leg protector FIG. 8, 9 is applied while standing, by placing the front of the leg in the middle of the inside of the protector. Attach the belt strap 7 as described and bring the top strap 70 around the back of the leg and secure 70*ab* the preferably hook fastener placed on the face of the protector 70*b.* Proceed to do the same for the middle strap 71 and the bottom strap 72 pressing the hook and loop fasteners together 71*ab.*, 72*ab.* to form a secure fit and then adjust for comfort.

The smaller leg protector 51*a.* that protects the leg from just below the knee to the top of the foot is put on by placing the protector in front of the leg below the knee and securing the top elastic webbing strap 80 first by bringing the strap around the back of the leg and aligning the preferably loop fastener placed at the end of the elastic webbing strap with the preferably hook fastener placed at the opposite lateral edge and on the face of the protector 80*ab.* Proceed with the bottom strap 81 pressing the hook and loop fasteners together 81*ab.* to form a secure fit. Adjust then for comfort.

The lateral edges 48 on the leg and arm protector can be secured to any degree depending on the number of and width of the elastic webbing straps.

The leg protector 56*a.* that protects the area of the leg from just above the knee to the top of the foot is put on preferably by placing the protector in front of the leg with the top elastic webbing strap 90 on the outside of the leg and positioned just above the knee. Pull the elastic top strap 90 around the back of the leg pulling firmly because this is the main support to keep the protector 56*a.* from slipping down the leg and secure 90*ab.* the preferably loop fastener 90*a.* placed at the end of said top strap 90 to the preferably patch of hook fastener 90*b.* placed on the edge of the opposite lateral side 90*c.* Proceed to align the preferably loop fasteners on the middle strap 91*a.* and lower elevation strap 92*a.* with their corresponding preferably hook fasteners 91*b.*, 92*b.* sewn along the edge of the opposite lateral side 91*c.* Firmly rub each of the hook and loop fasteners together 90*ab.*, 91*ab.*, 92*ab.* for a more secure fit and adjust for comfort.

Figure 17:
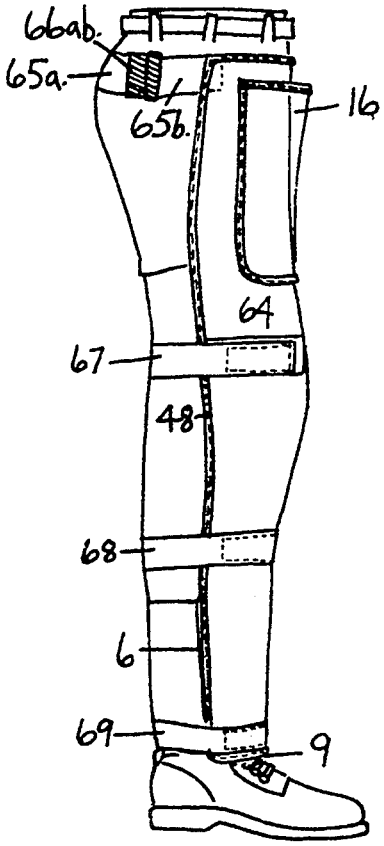
FIG. 17 is a view of the outside of a right leg that shows the belted full leg protector completely applied.
Figure 18:
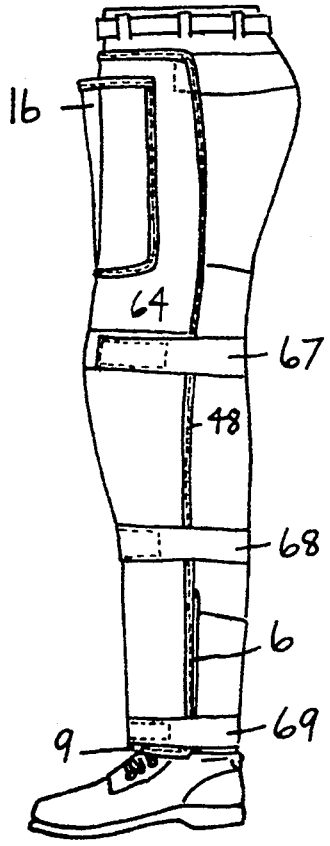
FIG. 18 is a view of the outside of a left leg that shows the belted full leg protector completely applied.

The belted full leg protector 64 as shown in FIG. 17, 18 extends the area of protection of the full strap leg protector as shown in FIG. 8, 9 to include the waist. By adding a single sheet of material in place of the belt straps 7 on a pair of full strap leg protectors 49*a.* and adding a belt to go around the waist at the top of that material, two individual leg protectors are changed into a one-piece full leg to waist protector.

The belt 65 is preferably constructed in two parts of two different types of materials. The longer side 65*a.* is made of a preferably polypropylene webbing that is rigid and has the male portion of a nylon quick-release buckle 66*a.* placed through and correctly positioned on said webbing strap 65*a.* The short side of the belt 65*b.* is preferably made of woven elastic webbing and has the female portion of a nylon quick-release buckle 66*b.* attached to the end of the elastic webbing. The elastic webbing is preferred on the short side of the belt 65*b.* to keep the top of the protector 5 and belt 65 from digging into the wearer by giving when bending over or kneeling down to do various activities.

In attaching the belted full leg protector 64, bring both sides of the belt 65*a.*, 65*b.* around the waist of the wearer until they meet and buckle securely together 66*ab.*, FIG. 17. Pull the end of the strap on the long side 65*a.* until the belt fits comfortably around the waist and the leg protector is hanging freely and positioned in front of both legs. Secure the top straps 67 of each leg before moving down to secure the middle straps 68 of each leg. Before securing the bottom straps 69 of each leg, a height adjustment may be necessary if the leg protector is too long. If it is necessary to make a height adjustment, turn the bottom elevation 9 of the leg protector back and under the leg protector 6 as shown in FIG. 17, 18, 19 and secure patch 3 of the preferably hook portion of the fastener to the vertical strip 4 of preferably loop portion of the fastener to obtain the correct height that is needed. Complete attaching the belted full leg protector 64 by securing the bottom strap 69 and adjust for comfort.

Figure 16:
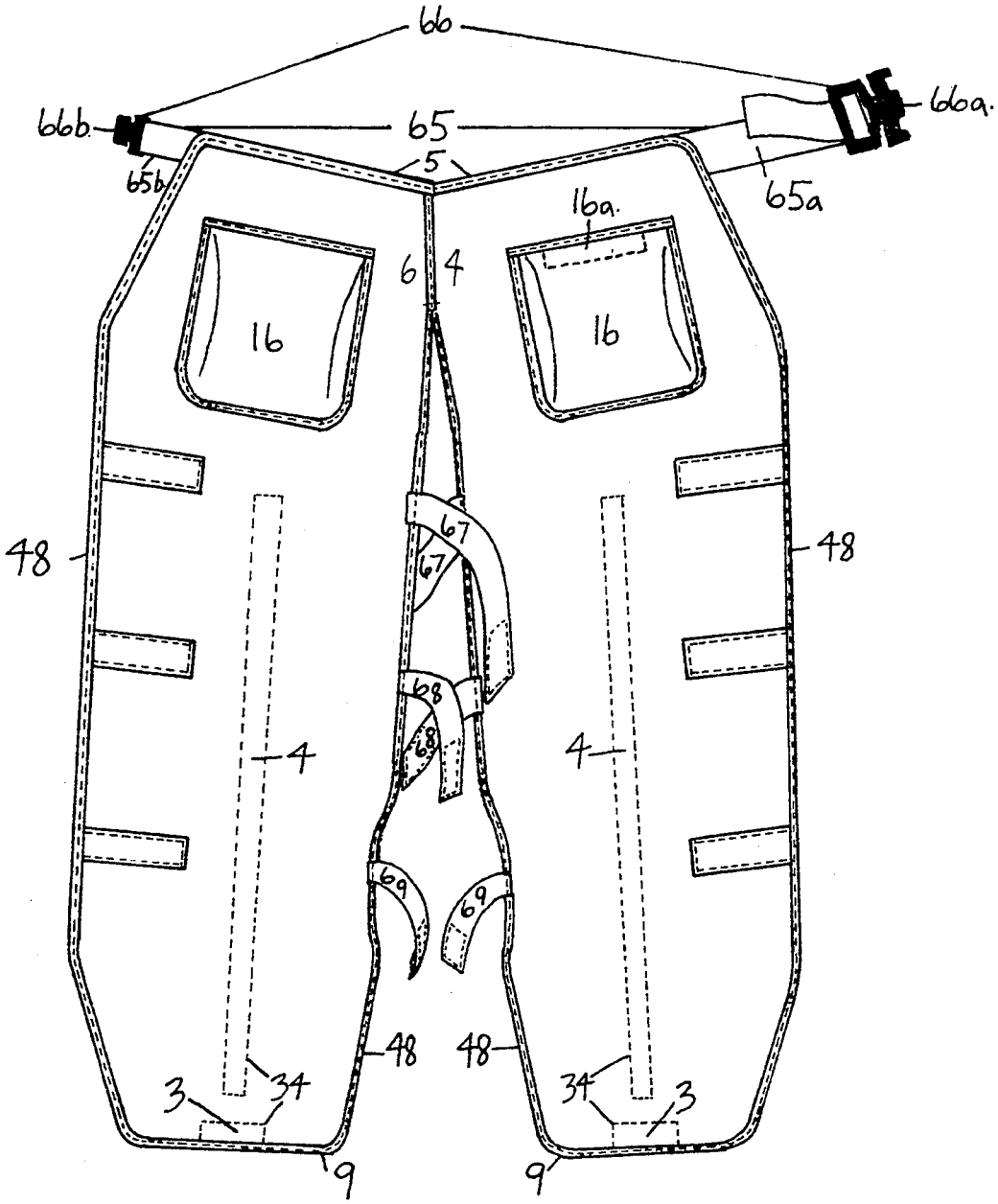
FIG. 16 is the front or outside view laid flat to more clearly illustrate the details of the belted full leg protector.

The height adjustment fastening system 34 FIG. 16, 19 is illustrated on the belted full leg protector; however this height adjustment fastening system can be used on any leg or arm protector that doesn't have material that has to overlap to be secured, like the parent application.

Figure 19:
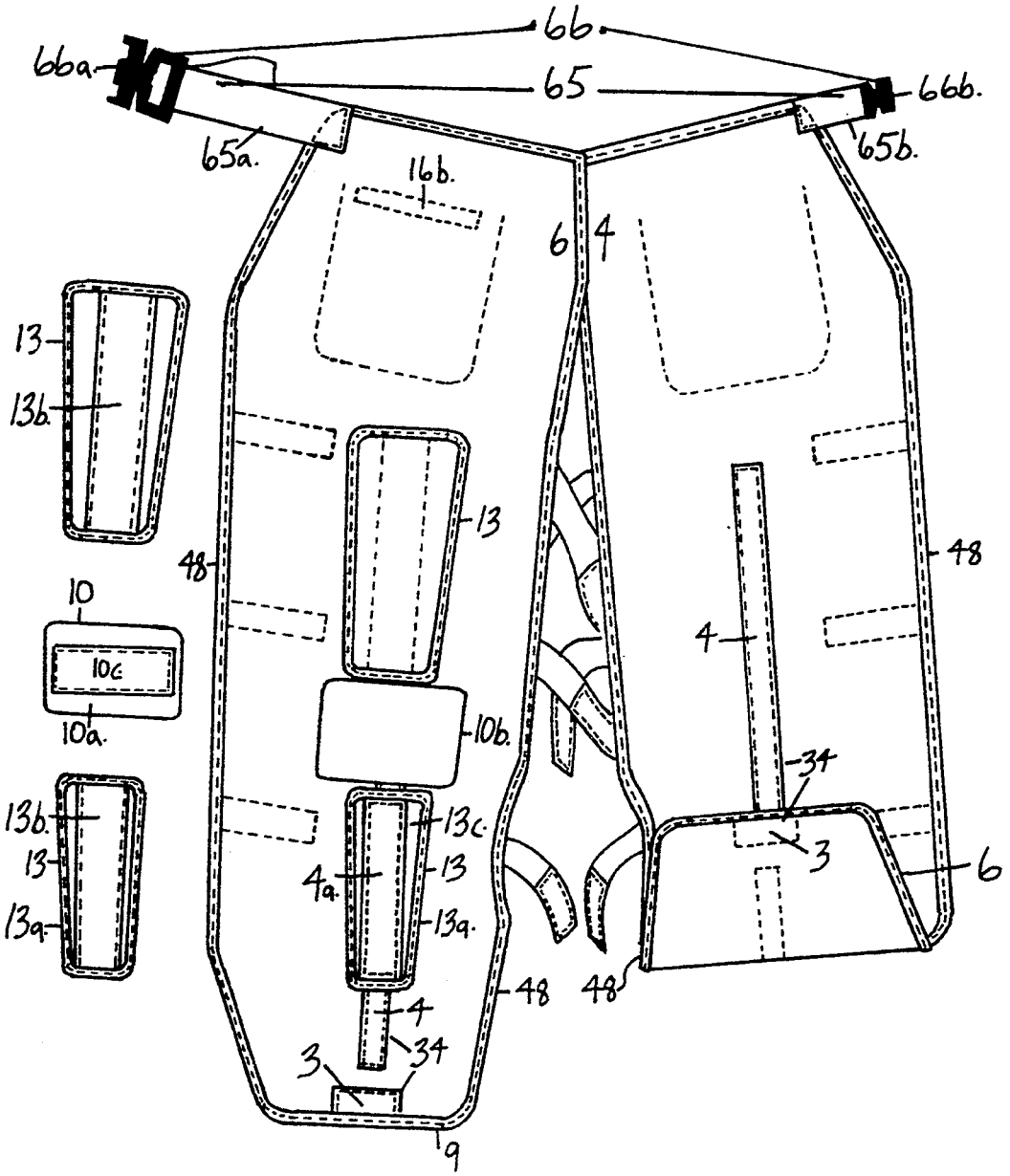
FIG. 19 is the back or inside view of the belted full leg protector laid flat, with additional protective guards and knee pad on the left. The protective guards and knee pad are shown applied to the inside of the left leg of the belted full leg protector and the right leg illustrates how height adjustment is made for the length of the protector.

The belted full leg protector FIG. 19 illustrates how the vertical strip 4 of said height adjustment system 34 also provides an area in the middle of the protector to attach additional protective guards and pads to all leg and arm protectors. By placing strips of preferably hook fastener to one side, the protective guards and pads can be moved up and down and side to side to accomodate the size of different legs and arms and the placement of the all important knee pad. The knee pad 10 is made of preferably ½ inch closed cell foam 10*a.* so that it doesn't absorb moisture and has a piece of preferably cotton material 10*b.* attached to the surface opposite the side with the strip of fastener 10*c.* for comfort. The guards 13 also have a strip 13*b.* of preferably the hook portion of said fastener attached to one side are constructed of material durable enough to withstand what you are protecting the leg or arm from. The opposite side 13*c.* of the guard 13*a.* for the lower elevation of the leg or arm protector has a strip 4*a.* of preferably loop fastener attached preferably vertically the length of the guard, to be able to secure to the preferably hook fastener 3 as shown in FIG. 19. This allows for the height adjustment fastening system to work with the addition of removable protective guards 13 and pads 10.

Figure 20:
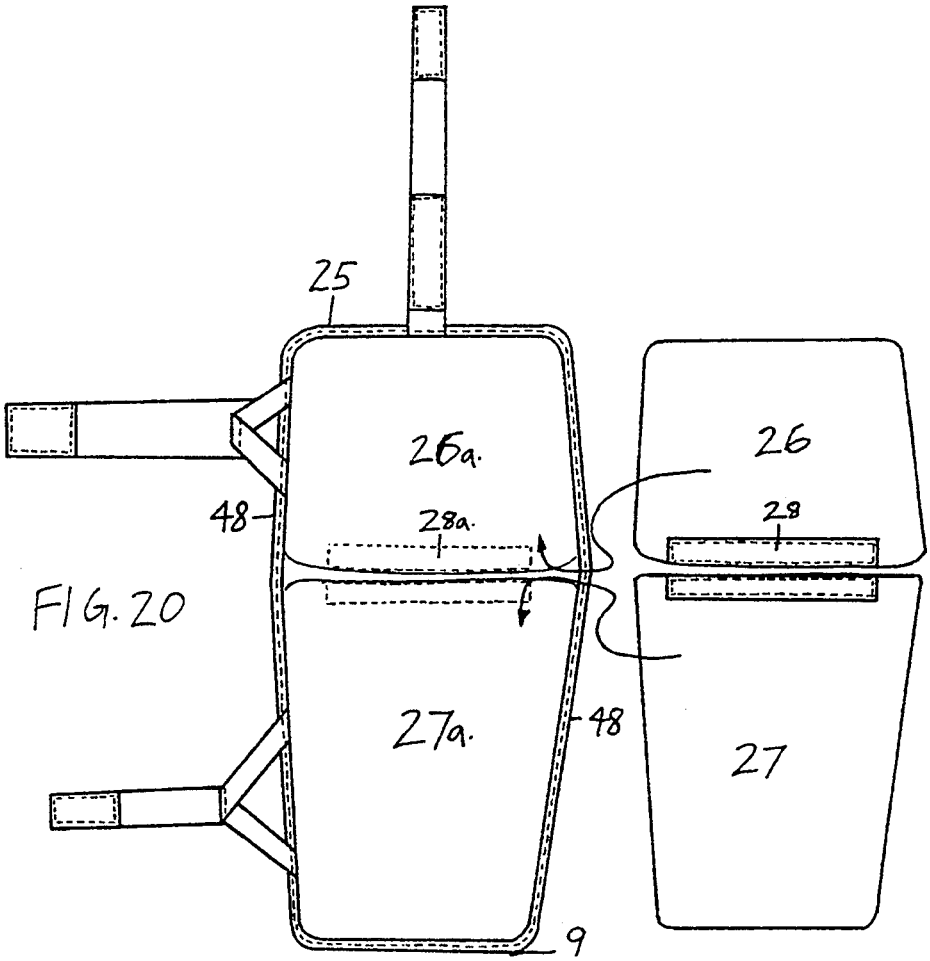
FIG. 20 shows the inside view of a leg protector that is designed to hold additional panels of protective material and an example of protective panels and how they insert into the leg protector at the right.
Figure 21:
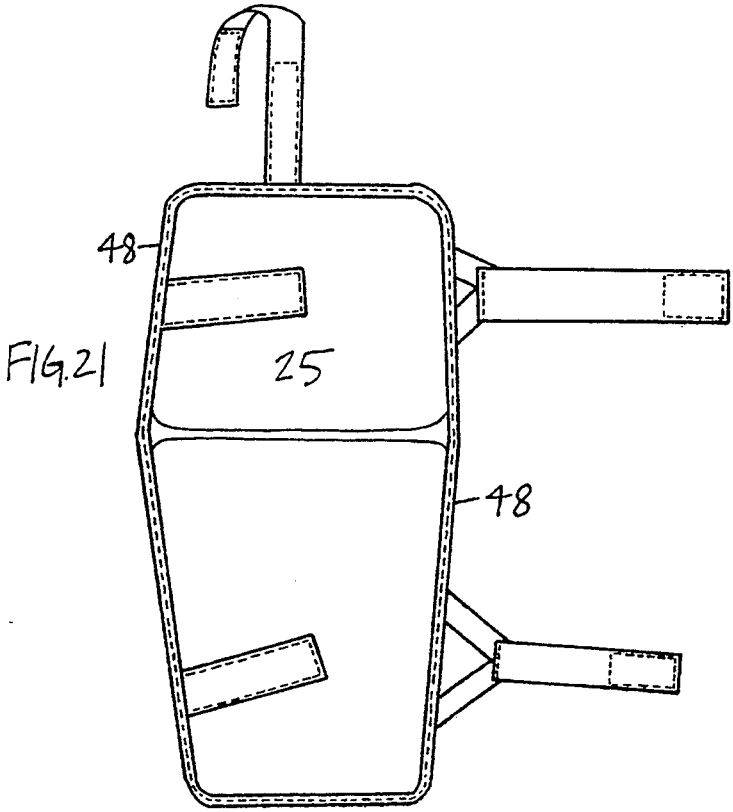
FIG. 21 shows the outside view of FIG. 20 with the protective panels in place.

Other removable protective guards and pads 26,27 can be added to the leg or arm protector by attaching a separate sheet of material to form a pocket 26*a.*, 27*a.* so that protective guards or pads 26, 27 can be inserted and then removed when necessary. FIG. 20 shows a leg protector with two areas 26*a.*, 27*a.* for protective guards or pads 26, 27 to be inserted. The top protective panel 26 has a strip of hook or loop fastener 28 attached to its lower elevation and positioned toward the wearer, so that when inserted into the pocket 26*a.* with a corresponding strip of hook or loop fastener 28*a.* sewn at the lower elevation on the inside of said pocket, the hook and loop fasteners are secured and the top panel is in place. Repeat the same method for inserting and securing in place the bottom protective panel 27.

This leg protector 25 was designed for Christmas tree trimmers that shape the trees before cutting them for the holidays. The trimmers use lightweight knives that are about 20 inches in length and very sharp in a slicing angular motion as they walk around the tree. High density impact plastic laminated to ¼ inch foam is sufficient protection for the tree trimmer from misdirected blows and cuts, but the unyielding flexibility of the high density impact plastic prevents the leg from its natural gait, and requires that the high density, impact plastic guard be cut in two at the knee area. That gives an example of why the pockets for the protective panels 26*a.*, 27*a.* on this particular leg protector 25 are placed where they are and the hook and loop fasteners 28, 28*a.* provide a system in which to secure said protective panels to the inside of the pockets even if the pockets are required to be upside down. This same system can include one or more pockets the length of the leg or arm protector or any portion from the upper elevation to the lower elevation of said leg or arm protector. If the protective pocket is to extend the full length of the leg or arm protector a flexible material such as KEVLAR ® or some similar type of material must be used so that free movement of all the different parts of the leg and arm are possible.

By attaching a separate sheet of material to the front or outside of the leg or arm protector to form a pocket 16, FIG. 16, 17, 18, an area is created to carry or store objects that otherwise would not be available. Objects can be secured inside said pocket 16 by attaching a strip of preferably loop fastener 16a. to the top of the inside of the pocket 16 and aligning and securing to a strip of preferably hook fastener 16b. placed on the protector FIG. 19.

The leg protectors described in the present invention are designed to be used while wearing shorts as well as while wearing long pants. The arm protectors are designed to be used when the arm is covered or when the arm is bare. It is the direct contact of the fasteners with many areas of the skin of the wearer that loop fasteners, which are soft, are stated as being preferred over hook fasteners, which are scratchy and hard, in different areas of said placement.

Positioned properly, a protective unit is formed that has eliminated many of the cumbersome construction devices and tedious securements that have been common to many of the leg and arm protectors heretofore proposed, thus providing a leg and arm protector that not only is lightweight and durable but also provides the means for offering maximum protection to the area where protection is most needed without having additional material that is not necessary.

The arm protector 23a. is preferably 11 inches in length 17, 19 with the upper elevation 14 being 9 inches in width and the lower elevation 12 being 7 inches in width. The full arm protector's 33a. length is determined by using long sleeve measurements.

Figure 10:
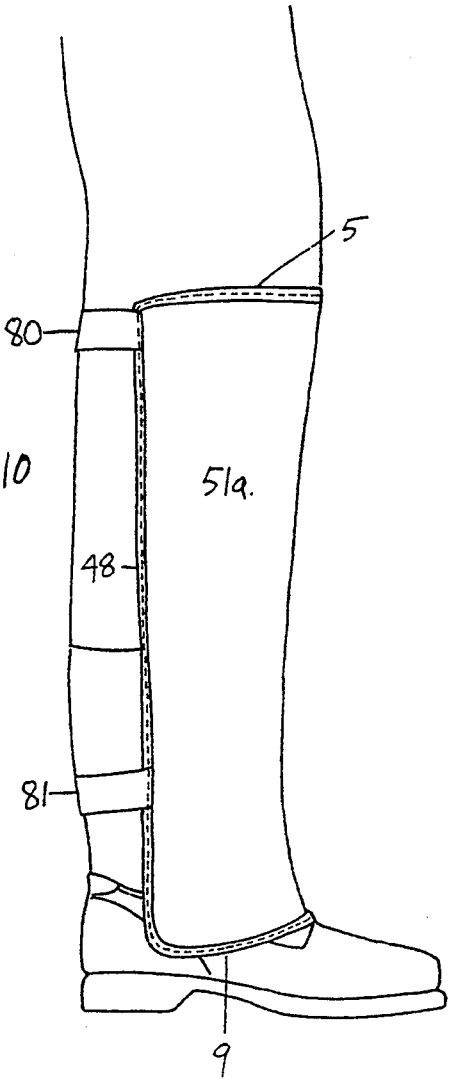
FIG. 10 shows the outside view of a smaller leg protector that covers the leg from below the knee down to the top of the foot, completely applied to a right leg.
Figure 11:
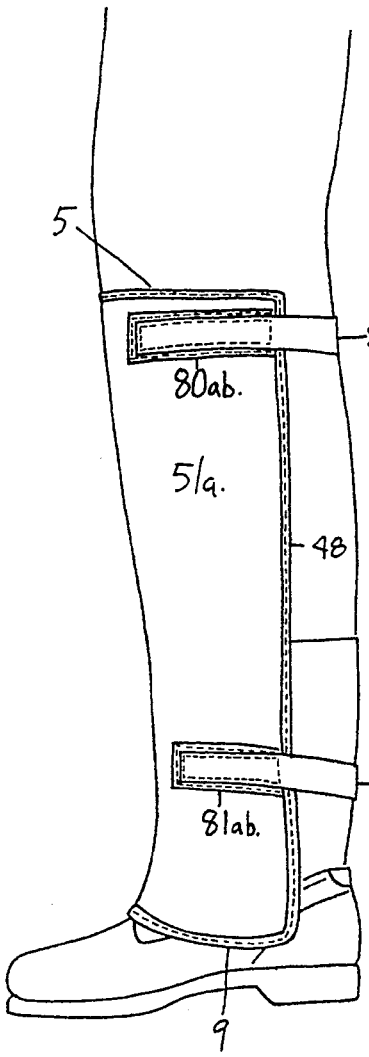
FIG. 11 shows the inside view of the right leg with the same smaller leg protector completely applied.
Figure 12:
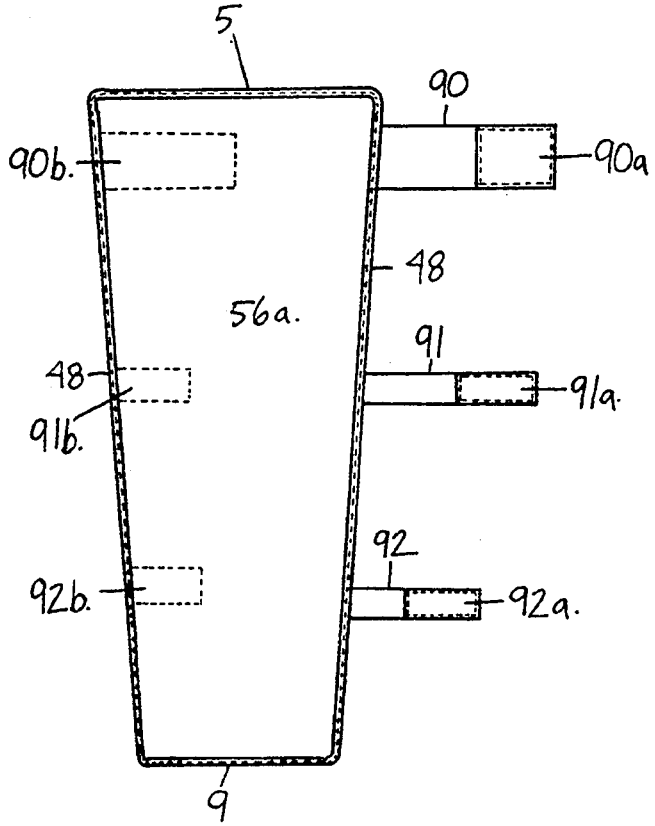
FIG. 12 shows a leg protector for the area just above the knee down to the top of the foot laid flat and opened out to more clearly illustrate the details of the inside of the leg protector that will be in contact with the leg of the wearer.
Figure 13:
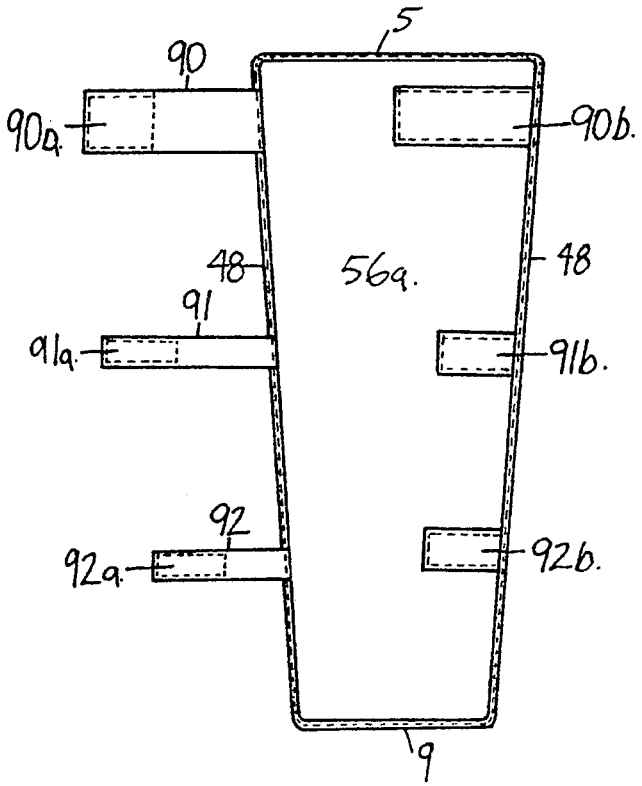
FIG. 13 is the front or outside view of the leg protector. It is the opposite of FIG. 12.
Figure 14:
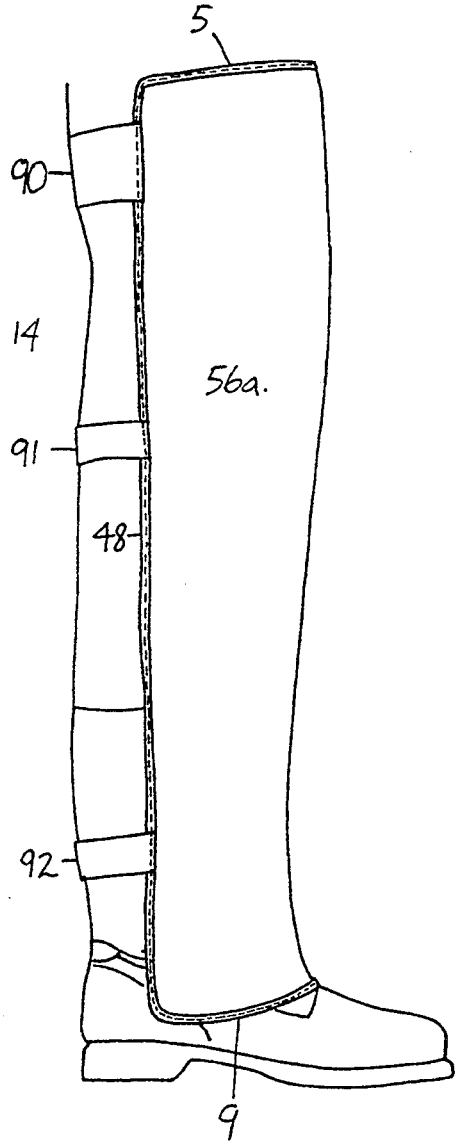
FIG. 14 is a view of the outside of a right leg with the leg protector in FIG. 12 completely applied.
Figure 15:
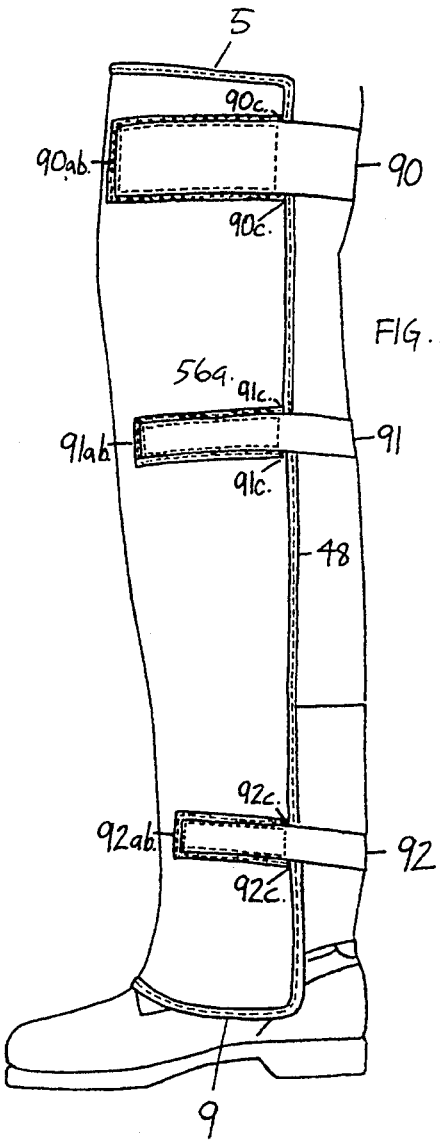
FIG. 15 is a view of the inside of a right leg with the leg protector in FIG. 12 completely applied.

The below the knee to the top of the foot leg protector 51a. is preferably 18 inches in length and 12 inches wide at the upper elevation 5 and 9 inches wide at the lower elevation 9, FIG. 10. The full strap leg protector 49a. is preferably 35 inches in length and 9 inches in width at the upper 5 and lower 9 elevation. The above the knee to the top of the foot leg protector 56a. is preferably 27 inches in length and 12 inches wide at the upper elevation 5 and 9 inches wide at the lower elevation 9. The belted full leg protector 64 is preferably 42 inches in length and 21 inches wide at the upper elevation 5 excluding the belt 65 and 9 inches wide at both of the lower elevations 9. The Christmas tree trimmer leg protector 25 is preferably 27 inches in length and 12 inches wide at the upper elevation 5 and 10 inches wide at the lower elevation 9, FIG. 20.

The measurements are for adult sizes and are only presented to help better visualize the dimentions that each formal drawing represents. The leg and arm protectors can be made to fit any size leg or arm.

The description, application, and illustrations presented for the right leg and right arm applies the same for the left leg and left arm.

It is apparent that the objects, aims and advantages already stated above have been fully satisfied by the present invention. Although the present invention has been described in relationship with specific embodiments, it is obvious that anyone with a sense of design or an understanding of how it is that the leg or arm can best be protected could make changes and take from the strength, simplicity and spirit of the present invention. Therefore, it is requested not to be bound by the foregoing except as may be required by the claims.

Having thus described the present invention I claim:

1. A leg protector for covering a portion of a human leg from a desired top location of the wearer's leg to the top of the foot comprising in combination:

a sheet of material cut in a shape to fit an area of a human leg desired to be covered having an inner surface, an outer surface, a pair of lateral edges and a pair of vertical edges adapted to be formed into a partial tube to go around the legs of the wearer leaving the back of said legs uncovered;

at least two straps attached at one end to one of the vertical edges of said protector with the other free end having a hook or loop component attached thereon;

at least two corresponding hook or loop fastener components attached to the other vertical edge on the outer surface of the protector for attachment to the corresponding hook or loop fastener on the straps;

a strip of hook or loop fastener material attached vertically to the central inner surface of the protector;

at least one protective pad having a corresponding hook and loop fastener attached thereon for attachment to the strip of hook and loop fastener material attached to said protector thereby providing adjustable and removable attachment of said pad to said protector;

pockets attached to said protector for holding additional protective pads or any items desired; and a length adjustment system at the lower end of said protector including a strip of hook and loop fastener material placed vertically on said inside surface of said protector and a corresponding horizontal strip placed perpendicular to said vertical strip for attachment to each other at a range of locations thereby adjusting the length of said protector.

2. A protector as claimed in claim 1 wherein said sheet of material is of a length to cover the leg of said wearer from said wearer's waist to the top of the foot.

3. A protector as claimed in claim 2 wherein a strap is attached at one end to the top lateral edge of said protector and has a hook and loop fastener component attached thereon and wherein the free end of the strap has a corresponding hook and loop fastener attached thereon for attachment to the corresponding component to form a loop for attaching said protector to a wearer's belt.

4. A protector as claimed in claim 2 wherein a belt is attached to the top lateral edge of said protector for connecting said protector to the wearer.

5. A protector as claimed in claim 1 wherein said protector is of a length to cover the wearer's leg from just above the wearer's knee to the top of the wearer's foot.

* * * * *